US005261835A

United States Patent [19]

Fang

[11] Patent Number: 5,261,835

[45] Date of Patent: Nov. 16, 1993

[54] 75 OHM AND 300 OHM COUPLER

[76] Inventor: Kun C. Fang, No. 101-2, Hai Liao T'sun, An Ting Hsiang, Tainan Hsuan, Taiwan

[21] Appl. No.: 952,659

[22] Filed: Sep. 28, 1992

[51] Int. Cl.[5] ..... H01R 13/58

[52] U.S. Cl. ..... 439/465

[58] Field of Search ..... 439/452, 465, 466, 467

[56] References Cited

U.S. PATENT DOCUMENTS 5,007,856 4/1991 Puemer ..... 439/452

*Primary Examiner*—Gary F. Paumen

[57] ABSTRACT

A 75 ohm and 300 ohm coupler having a housing tube consisting of an upper and a lower half tube respectively provided with tenons and mortises to engage one another securely to assemble both half tubes to become a cylindrical housing tube, a connecting head having a positive terminal and a negative terminal fitting inside one end of the housing tube, two 300 ohm lead wires enveloped in a rubber cover bored with holes for the tenons to pass through so as to secure the lead wires.

3 Claims, 4 Drawing Sheets

75 OHM AND 300 OHM COUPLER

BACKGROUND OF THE INVENTION

A conventional 75 ohm and 300 ohm coupler shown in FIGS. 1 and 2, comprises a housing tube A made of aluminum having two ends AO, AO, an end fitting with a large-diameter neck BO in a connecting head B, a central hollow A1 for depositing a PC board C therein securely, the other end of housing tube A holding a small soft wire holder A2 in the central hollow A1. The wire holder A2 is provided with a wire groove A20 to pinch therein two 300 ohm lead wires C1, C1, and an insulating plastic tube A3 is fitted around the housing tube A for insulating it.

Another conventional coupler shown in FIGS. 3 and 4, comprises a housing tube A' made of plastic, a wire grooves A1' prolead in one end of the housing tube A' for pinching two 300 ohm lead wires C1', C1', a connecting head B' having a positive terminal B1' and a negative terminal B1' of 75 ohm lead wires of a television antenna connected with a PC board C', which is then connected with the 300 ohm lead wires C1', C1'.

These conventional couplers are rather complicated and thus are expensive.

SUMMARY OF THE INVENTION

This invention has been devised to improve the above-mentioned conventional 75 ohm and 300 ohm coupler, by saving material used therein and time for assembling it.

One of the features of the present invention is that it does not use a PC board, by connecting a connecting head directly with 300 ohm lead wires in a secured condition.

Another feature is that a housing tube is formed of an upper half tube and a lower half tube respectively having tenons and mortises extending diametrically from an inner wall thereof for mutual engagement so as to unite both half tubes together securely.

DETAILED DESCRIPTION OF THE INVENTION

Figure 1:
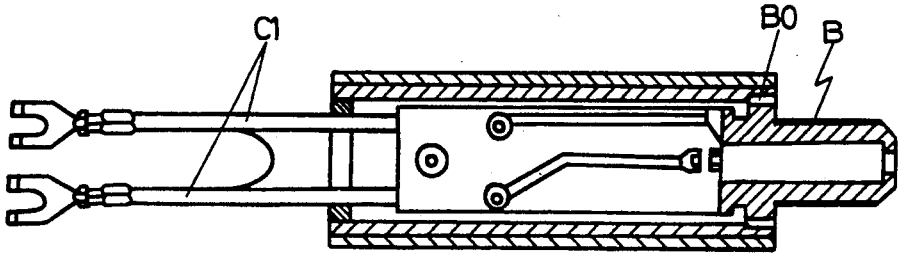
Fig 1 (PRIOR ART)
FIG. 1 is a cross-sectional view of a conventional 75 ohm and 300 ohm coupler.
Figure 2:
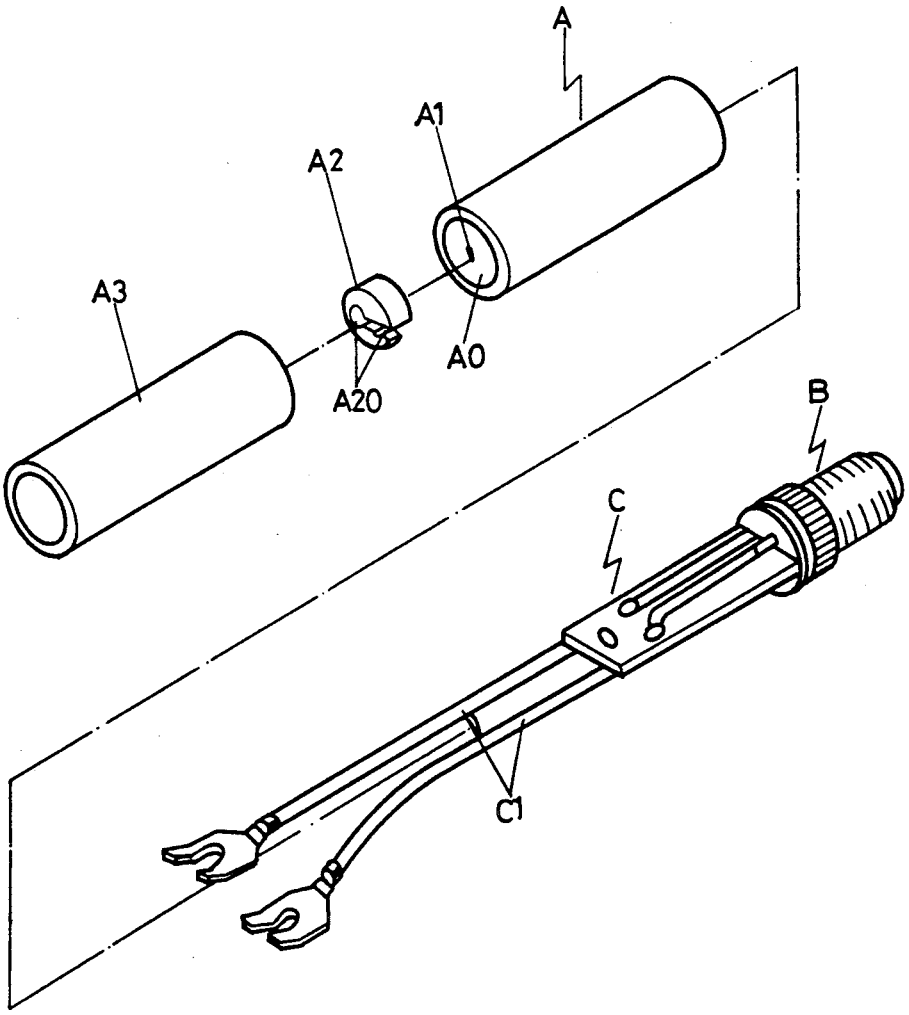
Fig 2 (PRIOR ART)
FIG. 2 is an exploded perspective view of the conventional 75 ohm and 300 ohm coupler in FIG. 1.
Figure 3:
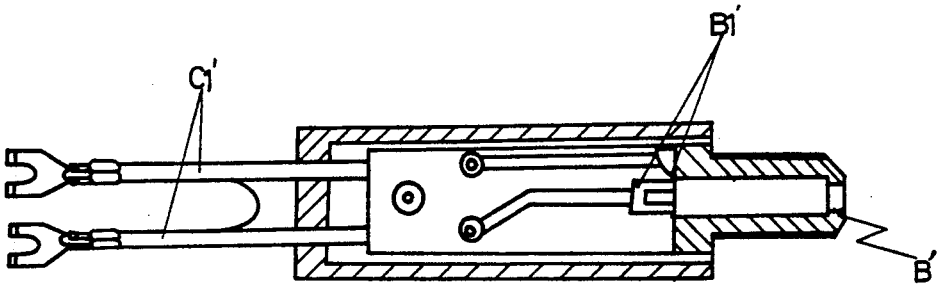
Fig 3 (PRIOR ART)
FIG. 3 is a cross-sectional view of another conventional 75 ohm and 300 ohm coupler.
Figure 4:
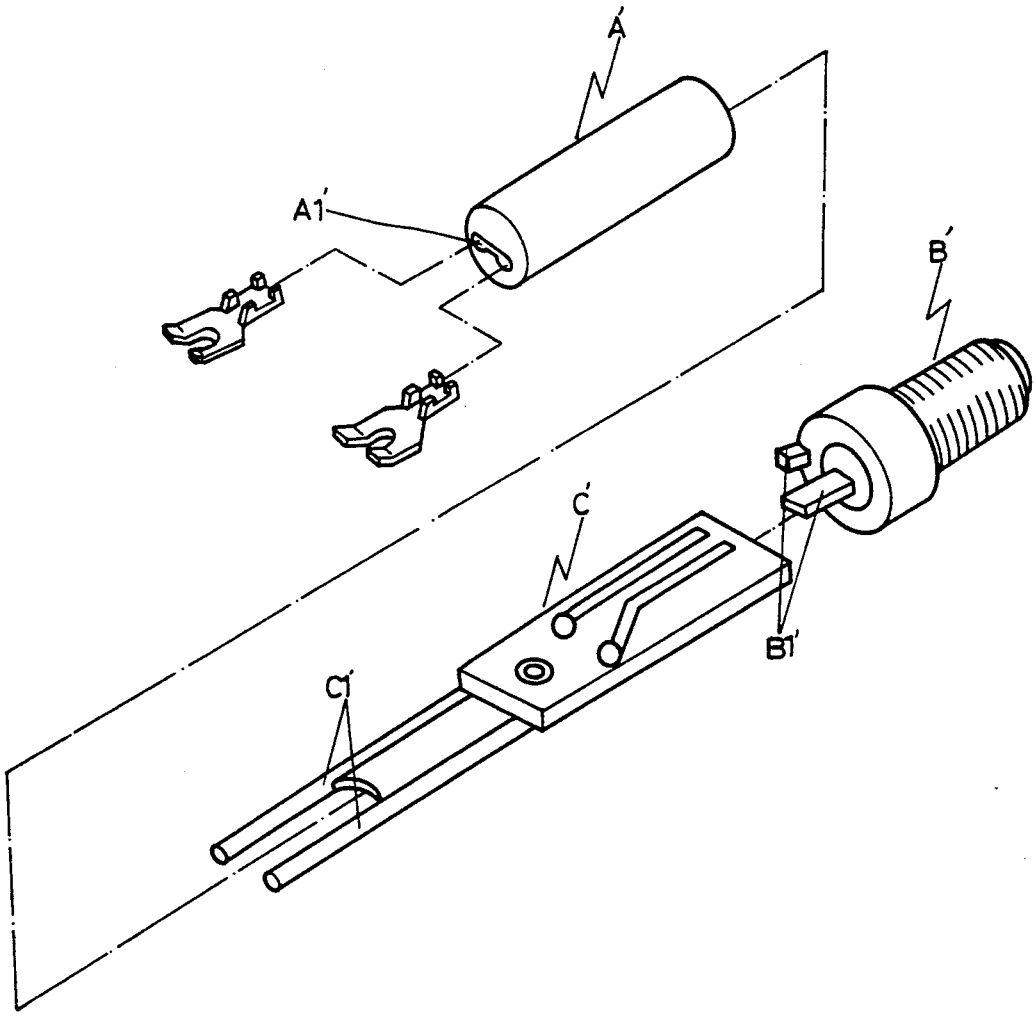
Fig 4 (PRIOR ART)
FIG. 4 is an exploded perspective view of the conventional 75 ohm and 300 ohm coupler in FIG. 3.
Figure 5:
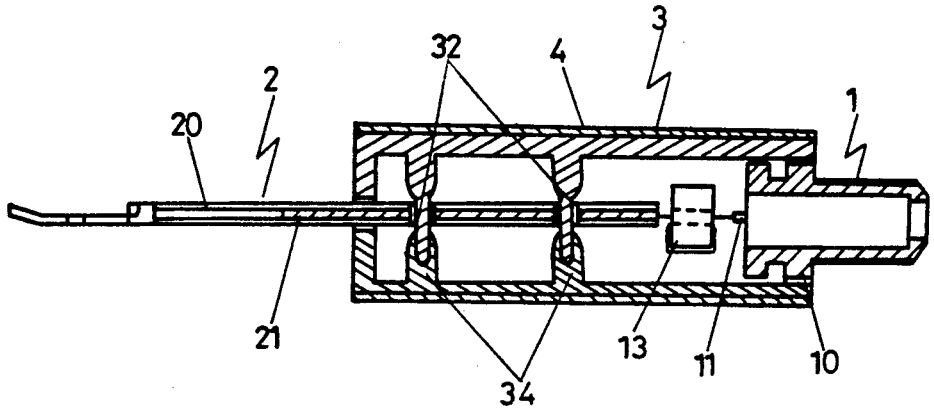
FIG. 5 is a cross-sectional view of a 75 ohm and 300 ohm coupler of the present invention.
Figure 6:
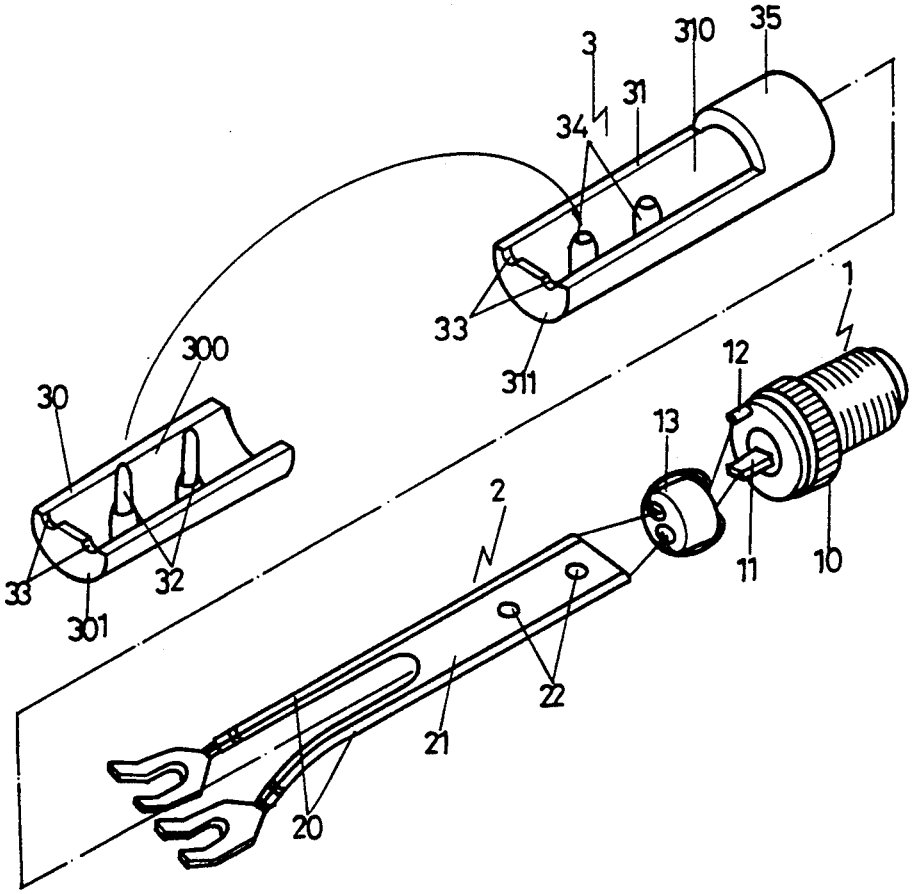
FIG. 6 is a perspective view of the 75 ohm and 300 ohm coupler of the present invention.
Figure 7:
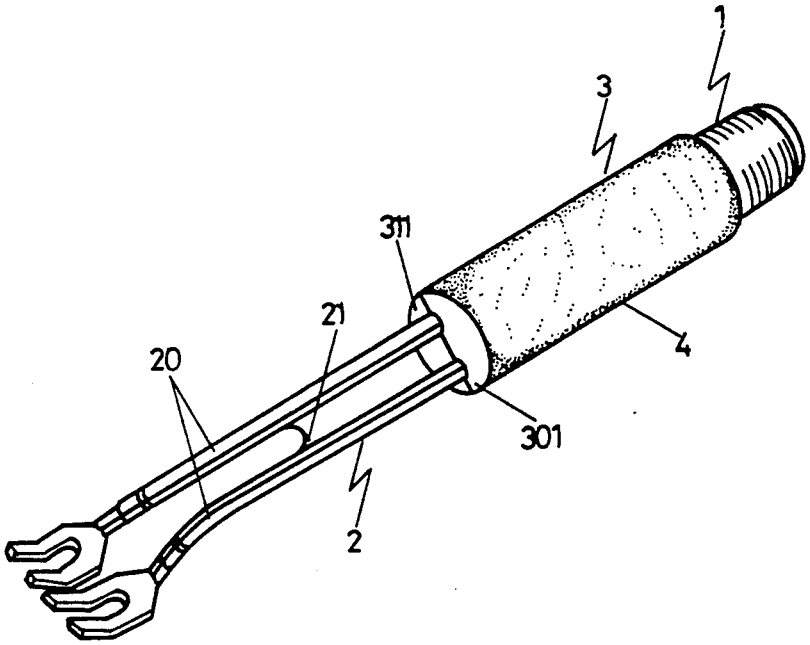
FIG. 7 is a perspective view of the 75 ohm and 300 ohm coupler of the present invention.

A 75 ohm and 300 ohm coupler of the present invention, as shown in FIGS. 5, 6 and 7, comprises a connecting head 1 for a 75 ohm cable of a television antenna to connect with a lead cable 2, and a housing tube 3, as main components joined together.

The connecting head 1 has a large diameter 10 and a positive terminal 11 and a negative terminal 12 extending lengthwise inward, a coil 13 connected with both the terminals 11, 12 at one side and with the lead cable of 300 ohm at the other side.

The 300 ohm lead cable 2 has two wires 20, 20, and a rubber or plastic cover 21 enveloping the wires 20, 20 and bored with two holes 22, 22 for two tenons 32 of a upper half housing tube 30 to pass through to fit in mortises 34 of a lower half housing tube 31.

The housing tube 3 consists of the upper half housing tube 30 and the lower half housing tube 31 joined together. The upper half housing tube 30 has two tenons 32, 32 extending diametrically from an inner wall 300, and two semi-circular notches 33, 33 in a straight edge of a rear wall 301. The lower half housing tube 31 has two mortises 34, 34 extending diametrically from an inner wall to engage the tenons 32, 32 to join both half housing tubes 30, 31 together to become a complete housing tube 3, two semi-circular notches 33, 33 in a straight edge of a rear wall 311 to form circular holes for the wires to pass through after both half housing tubes 30, 31 are joined together. The lower half housing tube 31 additionally has a cylindrical portion 35 with an opening to fit with a circumference of the large-diameter portion 10 of the connecting head 1 to unite the housing tube 3 with the head 1. The tenons 32, 32 pass through the two holes 22, 22 as shown in FIG. 5 so as to secure the lead cable 2 fixedly without needing a PC (poly chlorinated) board.

A flexible tubular diaphragm 4 is provided to envelope the housing tube 3, as shown in FIG. 7.

What is claimed is:

1. A 75 ohm and 300 ohm coupler comprising:

a connecting head for connecting television antenna lead wires, having a large diameter portion, a negative terminal and a positive terminal extending from an inner end face of the large diameter portion and connected with a coil:

a lead cable comprising lead wires of 300 ohm enveloped with a plastic cover bored with two holes;

a housing tube consisting of an upper half housing tube and a lower half housing tube joined together, the upper half housing tube provided with two tenons extending from an inner wall thereof, the lower half housing tube provided with two mortises extending from an inner wall thereof, both of said half housing tubes provided with two semicircular notches which become complete circular holes after both said tubes are joined; and said two tenons engaging said two mortises and passing through the two holes in said plastic cover of the lead cable so as to secure the lead wires fixedly.

2. The 75 ohm and 300 ohm coupler as claimed in claim 1, wherein said positive terminal and said negative terminal are fixedly connected with the lead wires of 300 ohm without using a PC board between them.

3. The 75 ohm and 300 ohm coupler as claimed in claim 1, wherein said housing tube is enveloped with a flexible diaphragm.

* * * * *